United States Patent [19]

Caporusso et al.

[11] 4,055,069

[45] Oct. 25, 1977

[54] PORTABLE MANUALLY CONTROLLED HYDRAULIC PIPE BENDING APPARATUS

[76] Inventors: Alessandro Caporusso; Mario Caporusso, both of Viale dei Mille, 12, Frosinone, Italy

[21] Appl. No.: 672,438

[22] Filed: Mar. 31, 1976

[30] Foreign Application Priority Data

| | | |
|---|---|---|
| Apr. 3, 1975 | Italy | 12203/75 |
| Sept. 8, 1975 | Italy | 51236/75 |
| Feb. 18, 1976 | Italy | 48162/76 |

[51] Int. Cl.[2] ..... B21D 7/06

[52] U.S. Cl. ..... 72/389; 72/453.16

[58] Field of Search ..... 72/453.16, 453.15, 389, 72/385, 386

[56] References Cited

U.S. PATENT DOCUMENTS

| | | | |
|---|---|---|---|
| 2,254,613 | 9/1941 | Matthysse | 72/453 |
| 2,255,985 | 9/1941 | Pfauser | 72/453 |
| 2,729,063 | 1/1956 | Hoadley | 72/453 |
| 2,867,261 | 1/1959 | Traupmann | 72/389 |
| 3,030,838 | 4/1962 | Klingler | 72/453 |

FOREIGN PATENT DOCUMENTS

| | | | |
|---|---|---|---|
| 1,001,604 | 10/1951 | France | 72/389 |
| 481,293 | 5/1953 | Italy | 72/389 |

*Primary Examiner*—C.W. Lanham
*Assistant Examiner*—Gene P. Crosby
*Attorney, Agent, or Firm*—Young & Thompson

[57] ABSTRACT

A pipe bending device is manually operated to pump hydraulic fluid, under the influence of a first reciprocating piston, to extend a second reciprocating piston to bend the pipe. The hydraulic fluid is urged on the pressure stroke of the first piston past a first ball valve and further hydraulic fluid is drawn by the first piston past a second ball valve upon the suction stroke of the first piston. A manually operated lever operates the first piston by swinging movement of the lever through a predetermined angle. A third piston is contacted by that same lever upon further swinging movement of the handle beyond that predetermined angle, in order to open a return passageway for the hydraulic fluid to release the device. The return passageway can be controlled by a third ball valve, or by pins that open both of the first two ball valves.

9 Claims, 12 Drawing Figures

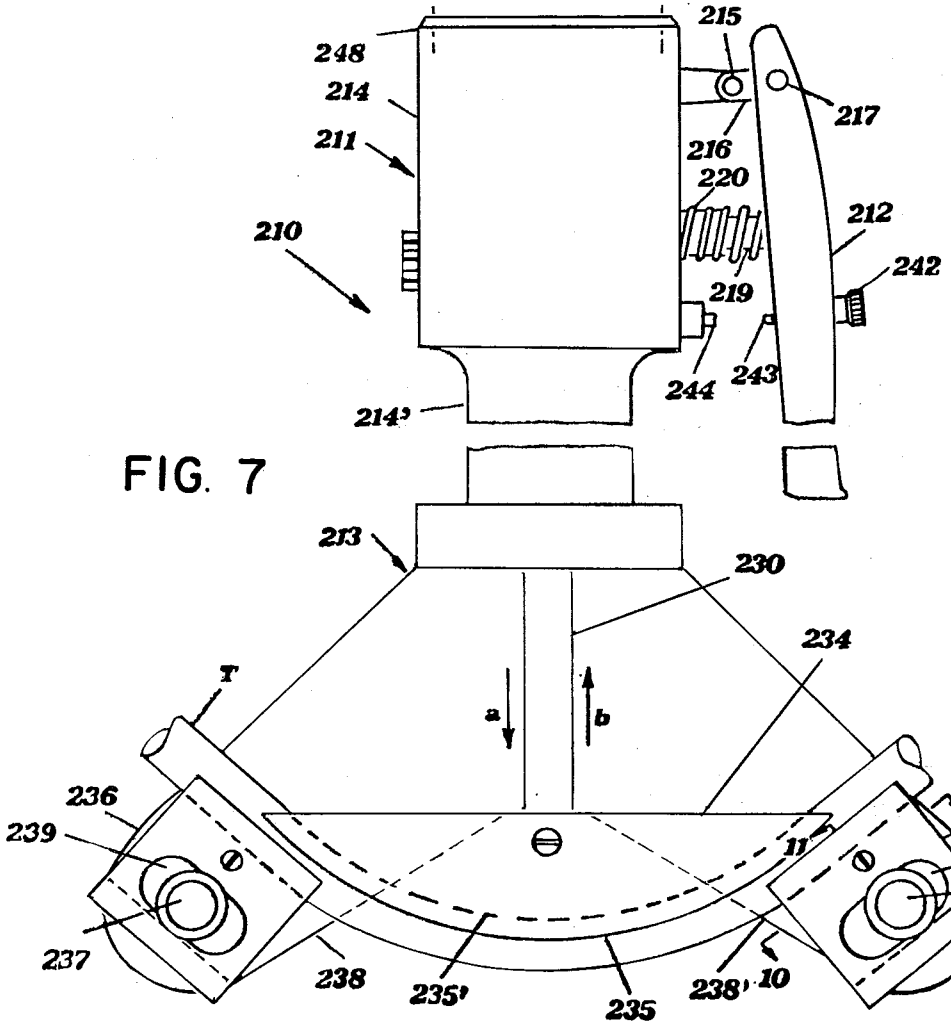
FIG. 7
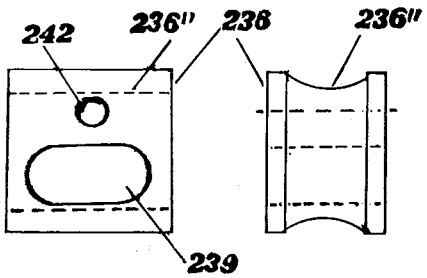
FIG. 8
FIG. 9
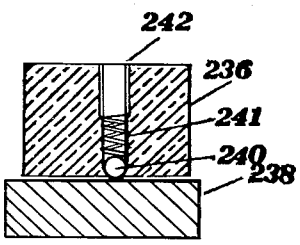
FIG. 10
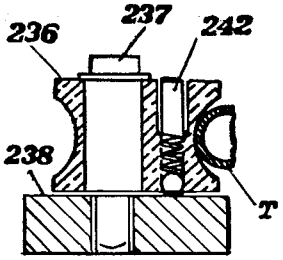
FIG. 11

PORTABLE MANUALLY CONTROLLED HYDRAULIC PIPE BENDING APPARATUS

The present invention relates to a pipe bending apparatus and particularly to a portable hydraulic pipe bending apparatus to be controlled manually and operated in any desired position, i.e. at a vertical or horizontal position or at any desired intermediate angle thereto.

Apparatus for pipe bending, both in new plants or to repair serviceable plants wherein pipes are used for fluid flow, call usually for requirements regarding the positioning of the pipes to be bent, particularly when the operation is to be carried out on the spot at the plant, for example for hot and/or cold water for sanitary and/or heating fittings, because during the installations the pipes are also to be adjusted by bending operations.

Attempts have been made to produce pipe bending apparatus to be used on the spot, the features of which considerably reduce not only its overall dimensions but also the compressor power when a hydraulic pipe bending apparatus is used. The pipe bending operation is usually carried out by employing a bending apparatus which comprises a framework resting on the ground, so that the pipe to be bent is to be placed in a predetermined position. Thus, in spite of these attempts, the pipe bending apparatus of the prior art is not fully satisfactory in its constructive and operative purposes, also because the pipe bending operation being carried out by same does not avoid any undesirable uneven stretching of the pipe which will be evidenced at a subsequent time.

On the other hand, the increasing installation of systems for heating and sanitary fittings, particularly for cold and hot water flow, increases the importance not only of an easy installation, but also of the economic factor as concerns pipe bending apparatus construction and production, and pipe installation costs.

By using the pipe bending apparatus in accordance with the present invention, the bending operation is made very much easier in any position of the pipe being considered as desirable or necessary, i.e. without any predetermined position of the pipe to be bent. Further, no framework and/or anyother auxiliary outside means is required for supporting or controlling the apparatus.

The main object of the present invention is to provide a hydraulic pipe bending apparatus of a portable type which is of simple construction and can be taken in one hand and controlled by the fingers of same, for being operated in any position being considered as desirable for suitably bending a pipe.

Moreover, the present invention aims to provide an easy manual control of that hydraulic pipe bending apparatus by means of a lever in order to easily carry out the reciprocating motion of pistons as well as the opening or closing of valves so that a proper fluid flow may be provided to progressively outwards shift an arched member nearer to two pipe supporting members and thus progressively perform the bending of a pipe which is retained therebetween, or draw back said arched member to its initial position at the end of the bending operation.

Another object of the present invention is to provide such pipe supporting members as interchangeable pieces, so that they may be suitable for bending pipes of different diameters.

A further object of the present invention is to provide a pipe bending apparatus wherein, because of the constructive features of the pipe supporting members, a rotary or roto-tanslating motion of same is automatically performed in accordance with the stretching stress of the pipe during the bending operation of same.

From the above, those skilled in the art may already deduce that this new simple, portable hydraulic pipe bending apparatus is an improvement compared to the prior art and many advantages are possible through its use.

Some embodiments of the invention will now be described, by way of examples, with reference to the accompanying drawings, in which:

FIG. 7 shows a partially removed frontal view of a pipe bending apparatus according to a third embodiment of the invention;

FIG. 8 shows a frontal view of a pipe supporting member of the apparatus of FIG. 7;

FIG. 9 shows a side view of said pipe supporting member;

FIG. 10 is a sectional view taken on the line 10—10 of FIG. 7;

FIG. 11 is a sectional view taken on the line 11—11 of FIG. 7;

Figure 1:
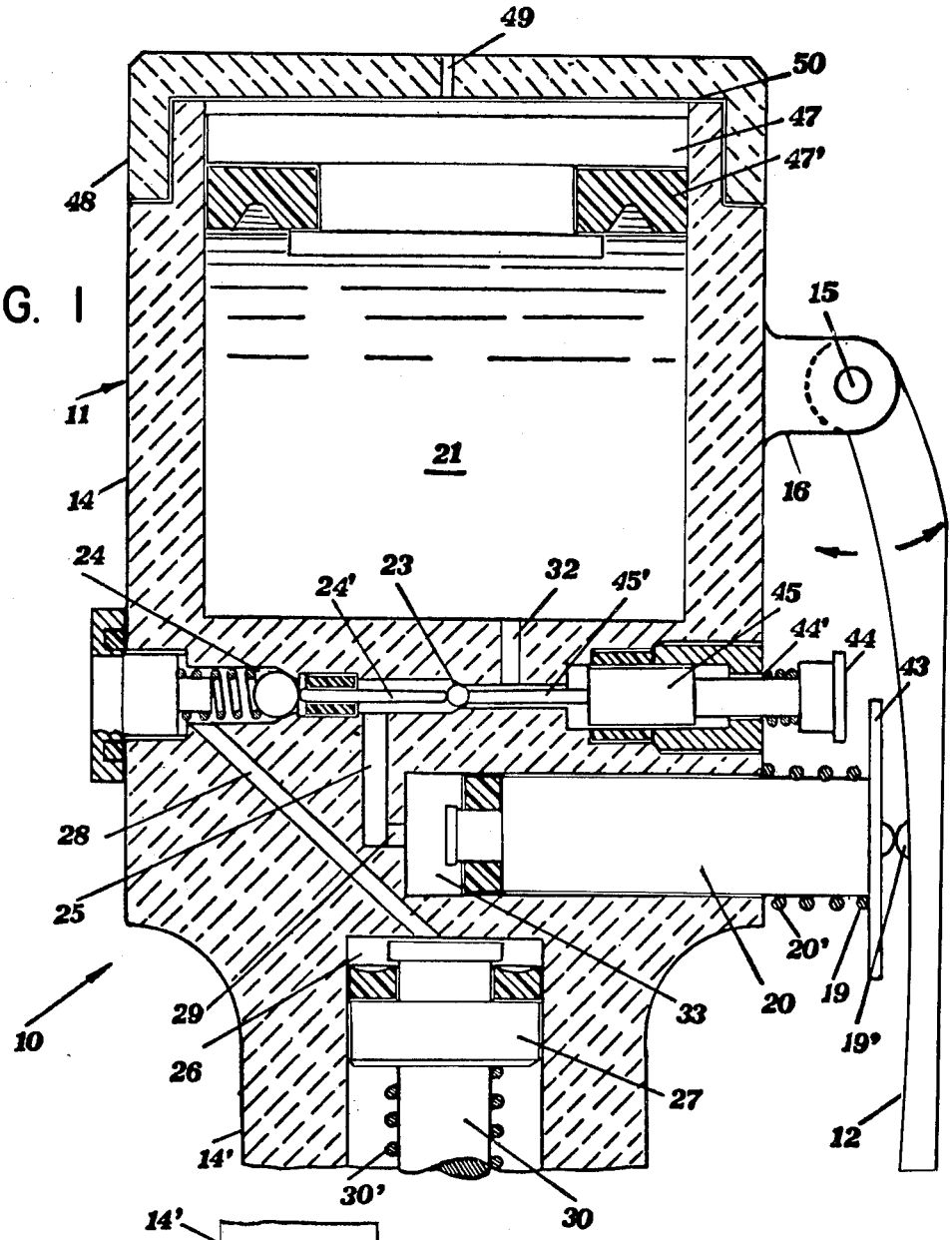
FIG. 1 is a longitudinal section of the upper portion of a pipe bending apparatus in accordance with a first embodiment of the present invention, which includes the valve and piston systems thereof.

Before describing these embodiments of the invention it is important to note that in any case the pipe bending apparatus in accordance with the present invention generally appears as in FIG. 7 (wherein it has been indicated by the reference numeral 210) and comprises three main parts, namely: a main body (211) with upper section (214) and lower section, or neck (214'); a control lever (212) which is pivotable about a pin of said upper section; and a fork section (213) which is integral with the bottom end of neck (214').

Moreover, the modifications between the examples of embodiments of the invention, which will hereafter be described, principally concern the arrangement of valve and piston members provided within the upper section of each main body, as well as the constructive and operative features of the supporting members of the tube to be bent, and the elastic cover of the fluid which fills the apparatus tank.

Figure 2:
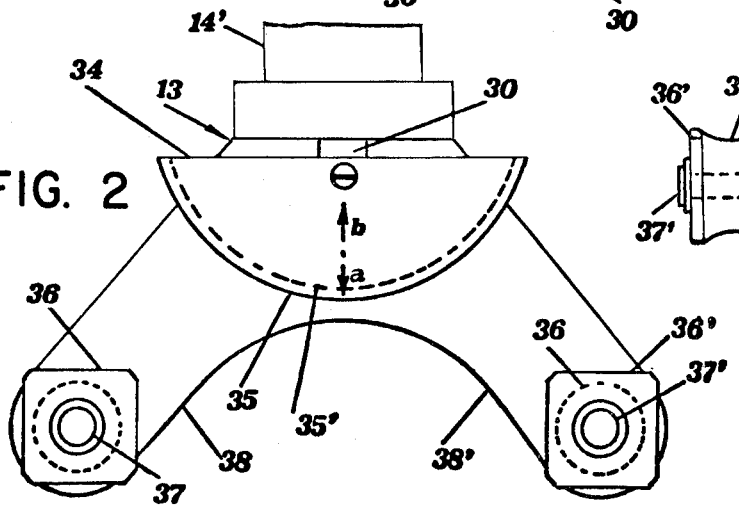
FIG. 2 shows in smaller scale a frontal view of the lower portion of the aparatus of FIG. 1.
Figure 3:
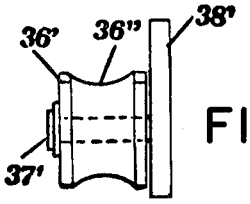
FIG. 3 shows a fragmentary side view of the lower portion of FIG. 2.

Turning now to FIGS. 1 to 3, there is illustrated a first embodiment of the invention. The pipe bending apparatus (see FIG. 1) which is generally indicated by the reference numeral 10, has a main body 11 comprising an upper section 14 and a lower section 14', or neck, the bottom end of which is integral with the fork section 13 (see FIG. 2) of the apparatus. Within the upper section 14 a large cavity 21 is provided which is used as a tank of the fluid of the apparatus, the open top end of which is covered by a closure member 48 wherein a central through-hole 49 is provided as a free passageway of air from and to the atmosphere. Cavity 21 is generally filled with oil to be properly supplied to the valve and piston systems of the apparatus during the operative cycles of same. The oil is sealed within tank 21 by means of a cover 47 and gasket 47', so that a chamber will be provided between the inner surface of closure member 48 and outer surface of shiftable cover 47, the volume of said chamber 50 being variable in accordance with the reciprocating motion of the pistons along their guiding cylinder walls.

A first piston 20 is provided, which is normally pushed outwards by means of a spiral spring 20' having its outer end acting against the flanged head 43 of piston 20. Because of this outwards motion of piston 20, a depression in chamber 33 of said cylinder-piston unit 20 is provided, so that a ball valve 23 is open while an opposite ball valve 24 is firmly closed as its ball is pushed by the valve spring against its seat. In this condition, which is the initial depression condition of each operative cycle of the apparatus when a pipe is to be bent, the oil is supplied from tank 21 to chamber 33 through passageways 32, 25, 29.

A second piston is shown at 27 which is movable within its cylinder, wherein a chamber 26 is also provided. Said piston 27 is usually pushed to the bottom of cylinder by a spiral spring 30' which is provided around piston stem 30 for said purpose. As better shown in FIG. 2, said stem 30 for said purpose. As better shown in FIG. 2, said stem 30 is extended through the top head of fork section 13, and on the free end thereof a member 34 is provided which is firmly connected thereto and has an outer arched edge 35 with a concave groove 35', facing the similar peripheral concave groove 36'' of supporting member 36, 36'. Because of this configuration, the pipe to be bent will be hold between the facing concave surfaces of said grooves during the progressive bending operation, as will be described hereafter and better shown in FIG. 7.

To shift piston 27 outwards, so that its stem 30 may carry out the pipe bending by means of arched member 34, lever 12 must be operated by the operator for a clockwise rotation. A pressure is then provided in chamber 33 so that the oil which had already been supplied therein is forced to flow through passageways 29, 28. In this condition valve 23 will be closed and valve 24 will be open, so that the compressed fluid may flow into chamber 26 through passageway 28 for shifting piston 27 outwards, as desired.

In this embodiment of the invention, interchangeable pipe supporting members are provided as at 36, 36', which are suitable for bending pipes of different diameters. To attenuate the influence of the stretching stresses during the bending operation and avoid as much as possible any stretching unevenness in the bent pipe, supporting members 36, 36' of this embodiment are also rotatable about pins 37, 37' respectively, which are fixed to fork legs 38, 38' (see FIGS. 2, 3).

It is to be recalled here that in each operative cycle a partial shifting only of piston 27 is provided in accordance with a corresponding motion of piston 20 into its cylinder seat, when lever 12 is manually operated with clockwise rotation about its pin 15, and that the operator must limit movement of lever 12 so that through the angular motion of this latter flanged head 43 of piston 20 does not reach flanged head 44 of a third piston 45, as this piston 45 must normally be hold in its outwards position which is defined by a spiral spring 44'. In this manner, the repeated positive actions of lever 12 on piston head 43, controlled by the operator, will lead to consecutive partial shifting of piston 27 and member 34 according to arrow *a*, that is to a progressive bending action of the pipe. The reversal stroke of piston 20, which is caused by spiral spring 20' when lever 12 is released by the operator, does not influence piston 27. Because of the depression within chamber 33 effected by said reversal stroke, ball valve 24 is closed and the compressed fluid will then remain within chamber 26 to avoid a reversal stroke of piston 27, while ball valve 23 is open and new fluid is supplied from tank 21 into chamber 33, as said above. The progressive lower level of the oil within tank 21 when the fluid is repeatedly supplied into chamber 33 during the operative cycle sequence controlled by the operator is compensated by a corresponding inlet of air into chamber 50 through passageway 49.

When the desired bending of the pipe is accomplished in the last operative stroke of piston 20, it is sufficient to extend the clockwise rotation of lever 12 so that also head 44 of third piston 45 can be moved as it is pushed by means of flanged head 43. In this manner, stem 45' of piston 45 will open not only ball valve 23, but also ball valve 24 on acount of the contemporary action of auxiliary rod 24' upon the ball of ball valve 24 against its spiral spring, so that the compressed fluid of chamber 26 may flow back to tank 21 through passageway 28, open valves 24 and 23 and passageway 32. The reversal stroke of piston 27 to its initial position according to arrow *b* (see FIG. 2) is then provided by the action of cylindrical spiral spring 30' upon piston 27.

The bending operation of a next pipe may then be started and continued as described above.

Figure 4:
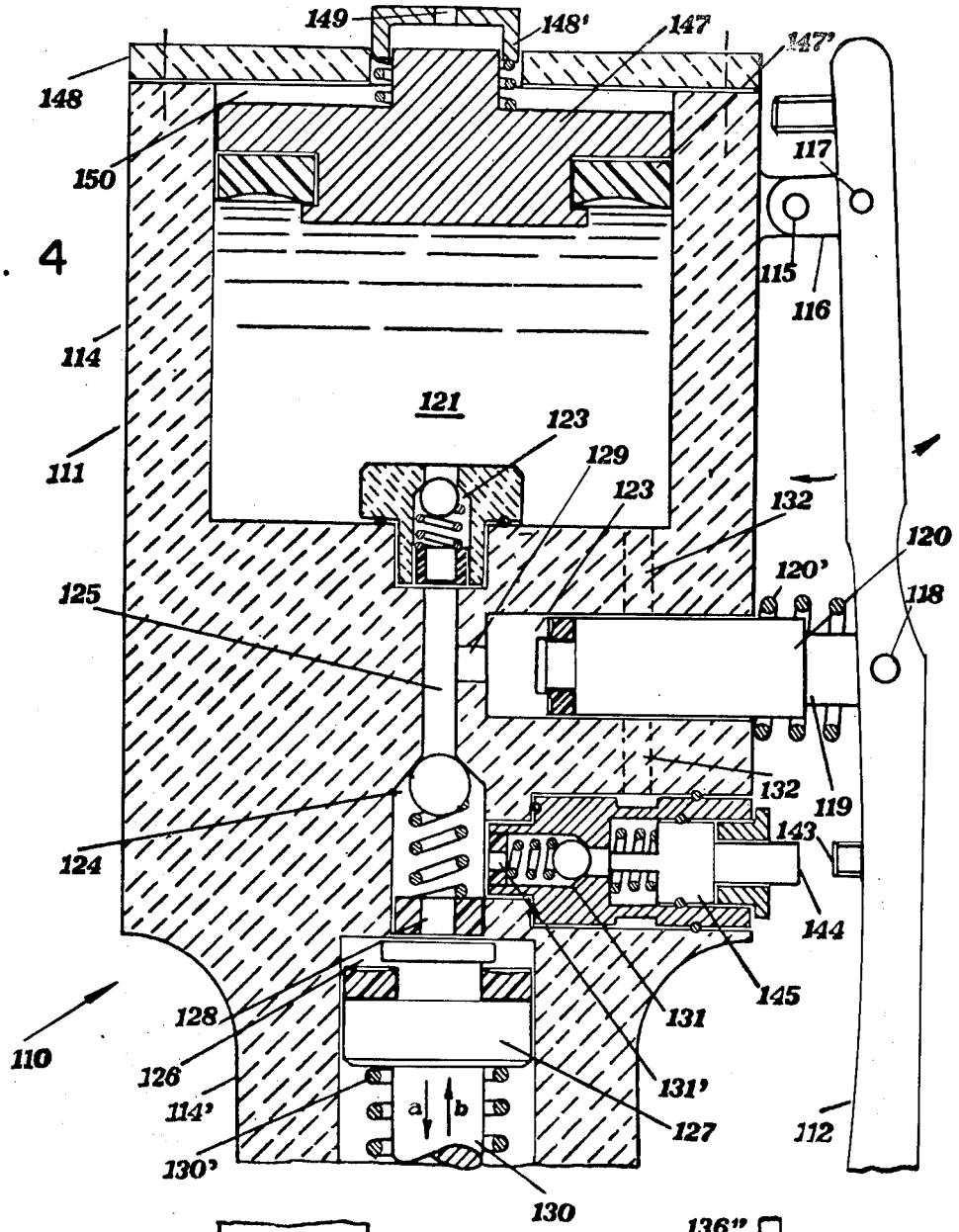
FIG. 4 is a longitudinal section of the upper portion of a pipe bending apparatus according to a second embodiment of the invention, which includes the valve and piston systems thereof.
Figure 5:
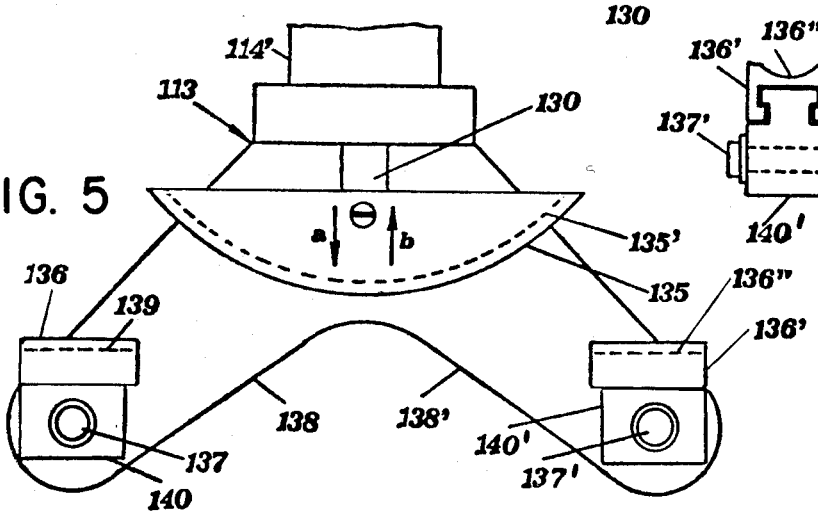
FIG. 5 shows in a smaller scale a frontal view of the lower portion of the apparatus of FIG. 4.
Figure 6:
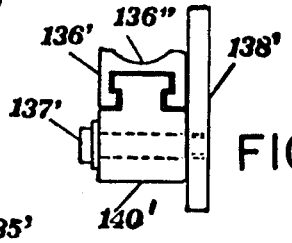
FIG. 6 shows a fragmentary side view of the lower portion of FIG. 5.

Re-ferring now to the second example of embodiment illustrated in FIGS. 4 to 6, these skilled in the art may easily note that the most important modifications in respect to the described and illustrated first embodiment of FIGS. 1 to 3 are substantially: (1) the central portion of the closure member of the main body cavity; (2) the arrangement of valve and piston systems within said main body of the apparatus; 3'') the constructive features of the pipe supporting members. In FIGS. 4 to 6 like elements in respect to FIGS. 1 to 3 are indicated with like reference numerals with addition of 100.

Turning to FIG. 4 there is shown a top closure member 148 fixed in a suitable manner to the top edge of main body 111, the central portion 148' thereof being elastically connected with top cover 147 of oil tank 121, so that this latter will be in a sealed condition at any level of the filling fluid during the bending operation of a pipe. Such elastic connection has often been found more suitable to balance the variation of air volume within chamber 150 in accordance with the variation of oil volume within tank 121, than in the embodiment illustrated in FIGS. 1 to 3. In FIG. 4 there is also shown a through-hole as a passageway of air to and from chamber 150, this through-hole being indicated with the reference numeral 149.

In this second embodiment of the invention, the opposite valves 123 and 124 are axially arranged within main body 111, as is also piston 127. The first piston 120 has its stem 119 pivoted on lever 112 at 118, which in turn is pivotable about pin 115 through a link arm 117 in order to avoid any undesirable stress when lever 112 is rotated during the bending operation.

As it may be seen in FIG. 4, a protruding pin 143 is provided on lever 112, which contacts outer stem head 144 of piston 145 when the clockwise rotation of lever 112 is extended up to said head at the end of the last operative bending cycle of the apparatus, so that piston 145 may be shifted inwards along its cylindrical wall against the spiral spring which is provided for ensuring the normal outwards position of said piston, as shown in FIG. 4. By means of the opposite inner stem of piston 145, the coaxial ball valve 131 will thus be open.

As shown in FIGS. 5 and 6, two-piece pipe supporting members 136, 140 and 136'. 140' are provided in this embodiment, these members being identical to each other, as in the first embodiment. Referring only to the pipe supporting member 136', 140' it may be seen that piece 140' is rotatable about a pin 137' which in turn is fastened to leg 138' of fork section 113, which a dovetail connection is provided between 136' and 140', so that the former may also translate along the upper surface of the latter. In this embodiment a roto-translating motion is then possible automatically for piece 136' which actually supports the pipe upon its concave groove 136" during the bending operation, and any stretching unevenness in the bent pipe is thereby avoided.

A third embodiment of the invention is illustrated in FIGS. 7 to 12 and described hereafter as a preferred embodiment of the present invention, with the previous statement that in this case some provided modifications are: (1) the central portion of the closure member of the main body cavity and particularly the elastic sealing cover of the tank; (2) the arrangement of valve and piston systems within said main body of the apparatus; (3) the constructive features of the pipe supporting members, so that in FIGS. 7 to 12 like elements in respect to FIGS. 1 to 3 are indicated with like reference numerals with the addition of 200. A further important modification relates however to the material used in the manufacture of this type of apparatus, as unlike the single aluminum material used in the first and second embodiments, in this embodiment all seats for valve and piston systems are shrunk in and solidly connected to a covering of aluminum or light alloy, for exmaple by a chill casting, the preferred material of the seats being bronze or brass.

Figure 12:
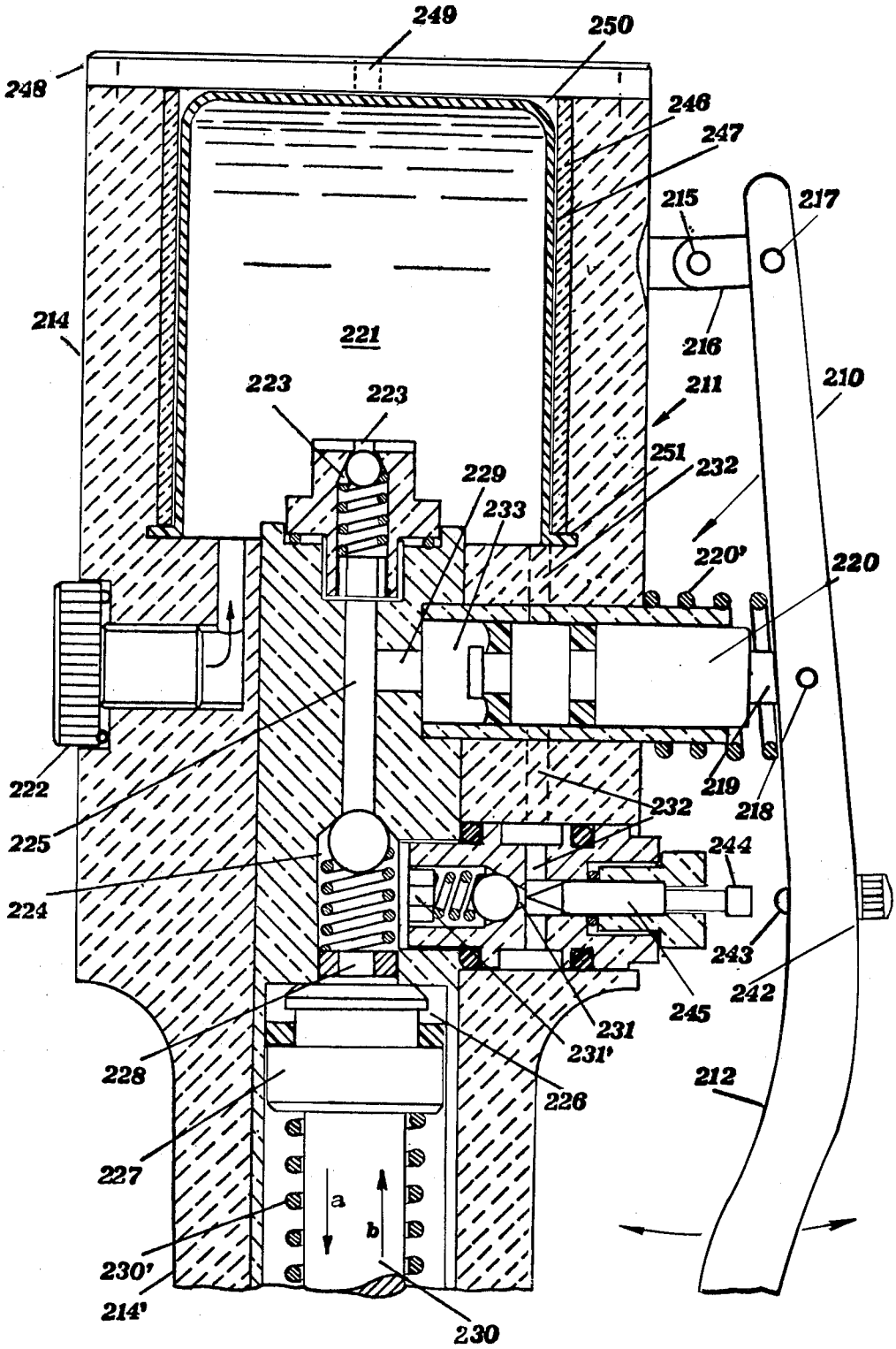
FIG. 12 is in a larger scale the longitudinal section view of the upper portion of the apparatus according to FIG. 7, which includes the valve and piston systems thereof.

Turning now to FIG. 12 there is shown an inlet hole with threaded plug 222 for filling oil tank 221, this latter being elastically sealed by means of an elastic membrane 247 having a top-hat shape, the bottom flange of which is inserted in a corresponding annular groove at the bottom of tank 221 and tightened by a brass jacket 246 thereof.

The valve and piston systems of this embodiment are substantially similar to the second embodiment, and it may be important to say only that pin 243, which acts upon stem head 244 for opening ball valve 231 at the end of a bending operation, is here adjustable and operated through its knurled head 242.

The front view of this preferred embodiment is shown in FIG. 7, wherein the central portion of neck 214' was removed. Pipe supporting members 236, 236' have a different configuration in respect to the first and second embodiments, and some details of the same are also shown in FIGS. 8 to 11. Each pipe supporting member is provided as a single piece which is mounted on pin 237, 237', respectively, about and along which the supporting member is movable. For this purpose, an elongated through-opening 239 or 239' (see also FIG. 8) is provided, and each supporting member has opposite linear grooves 236" which are differently spaced from the axis of pin 237 or 237', the sectional shape of said grooves being concave as in the first and second embodiments, in order to suitably support pipe T to be bent.

The arched member 234 is connected to piston stem 230 of piston 227 (see FIG. 12) as an integral piece having an outer arched edge 235 with a concave groove 235' facing the concave grooves 236" of pipe supporting members 236 and 236'. The pipe to be bent is also here held between said concave grooves, as shown in FIG. 7.

To avoid a very easy roto-translating motion of pipe supporting members 236, 236' about and along pins 237, 237', respectively, a braking dowel 242 (see FIGS. 10, 11) is also provided, which acts on ball 240 through a cylindrical spiral spring 241. As it results from many experiments of the inventors, the unevenness of stretching in a bent pipe is in this manner avoided.

It will be understood that the above described and illustrated embodiments of the invention do not limit the possibility of further changes and modifications that those skilled in the art may select in accordance with the desired use of the apparatus of the present invention and within the principles of same.

What we claim is:

1. A portable hydraulic pipe bending apparatus which is operated manually and comprises: a main body with valve and piston systems therein enclosed; a control lever pivotable about a pin of said main body; and a fork section which is integral with the bottom end of said main body; said main body having: an upper section wherein a central cavity is provided to be used as a fluid tank, the top open end of which is closed by means of a closure member with a vent-hole, while a sealing, movable cover is provided over the fluid which fills said tank, said valve and piston systems being arranged within said upper section; and an elongated lower section the end of which is integral with said fork section of the apparatus, to the legs of which corresponding pins are fastened for guiding pipe supporting elements in rotation about said pins when a pipe bending operation is carried out; said valve and piston systems comprising: a pair of opposite ball valves for inlet or outlet fluid flow; a first cylinder-piston unit, with the piston normally held in its outwards position by a spring to intake the fluid from said tank, and which may be operated manually by means of said lever for a positive stroke which must be limited by the operator up to a predetermined angle of said lever; a second piston, to the free end of which an arched member is provided having a peripheral concave groove facing said concave grooves of said pipe supporting elements, so that a pipe to be bent may be held and bent therebetween; a third piston which is driven only when the manually controlled rotation of said lever is extended beyond said predetermined angle, to open a passageway to reverse the fluid flow and return said second piston to initial position at the end of a pipe bending operation.

2. An apparatus according to claim 1, wherein said first and third pistons are crosswise placed and reciprocating within said upper section of said main body, while said second piston is axially placed and reciprocating within said upper section and its stem gradually extends outwards during repeated operative cycles for bending a pipe.

3. An apparatus according to claim 1 wherein said sealing movable cover of the fluid within said tank is an elastic memberane which follows the variation of fluid therein.

4. An apparatus according to claim 1 wherein the volume variation of the fluid within said tank is balanced by the volume variation of air, the inlet and outlet of which is provided through said vent-hole.

5. An apparatus according to claim 1 wherein the main body and the fork section are of light metal machined to provide said tank and valve and piston seats.

6. An apparatus according to claim 1 wherein bronze or brass machined pieces are used as tank and valve and piston seats, which are embedded in a covering of cast light metal.

7. An apparatus according to claim 1 wherein two interchangeable circular and like pipe supporting elements are provided which are mounted on the two legs of said fork section of the apparatus, each supporting element being provided with a peripheral concave groove.

8. An apparatus according to claim 7 wherein each supporting element is a two-piece member, one of which is rotatable about its pin, while the second piece is dovetail connected to the former in order to translate along the upper surface of same.

9. An apparatus according to claim 7 wherein each supporting element is a single-piece member with an elongated through-opening for roto-translating about and along its guiding pin, two opposite linear, concave grooves being provided which are differently spaced from the axis of the guiding pins.

* * * * *